US011432609B2

(12) United States Patent
Salvetti et al.

(10) Patent No.: US 11,432,609 B2
(45) Date of Patent: Sep. 6, 2022

(54) SAFETY HELMET WITH ADJUSTABLE COMFORT LINER

(71) Applicant: NOLANGROUP S.p.A., Brembate di Sopra (IT)

(72) Inventors: Alberto Salvetti, Brembate di Sopra (IT); Alberto Mandelli, Brembate di Sopra (IT); Giuseppe D'adda, Brembate di Sopra (IT)

(73) Assignee: NOLANGROUP S.P.A., Brembate di Sopra (IT)

( * ) Notice: Subject to any disclaimer, the term of this patent is extended or adjusted under 35 U.S.C. 154(b) by 106 days.

(21) Appl. No.: 16/517,986

(22) Filed: Jul. 22, 2019

(65) Prior Publication Data

US 2020/0029643 A1 Jan. 30, 2020

(30) Foreign Application Priority Data

Jul. 25, 2018 (IT) ..... 102018000007484

(51) Int. Cl.
*A42B 3/06* (2006.01)
*A42B 3/04* (2006.01)

(52) U.S. Cl.
CPC ..... *A42B 3/062* (2013.01); *A42B 3/0406* (2013.01)

(58) Field of Classification Search
CPC ..... A42B 3/062; A42B 3/0406; A42B 3/00; A42B 3/04; A42B 3/06; A42B 3/063; A42B 3/064; A42B 3/10; A42B 3/12; A42B 3/127; A42B 3/14; A42B 3/142; A42B 3/145; A42B 3/147
USPC ... 2/410, 411, 412, 414, 415, 416, 417, 418, 2/419, 420
See application file for complete search history.

(56) References Cited

U.S. PATENT DOCUMENTS 3,016,541 A * 1/1962 Archbold ..... A42B 3/14 2/419
5,815,847 A 10/1998 Holden, Jr.
2004/0049830 A1 3/2004 Gafforio et al.
2006/0230507 A1 10/2006 Yeh
2009/0158506 A1 6/2009 Thompson et al.
(Continued)

FOREIGN PATENT DOCUMENTS

DE 3129199 A1 2/1983
EP 1591030 A1 11/2005
EP 3132702 A1 2/2017

OTHER PUBLICATIONS

Italian Search Report for Corresponding Italian Application No. IT 201800007541 (7 Pages) ( dated Mar. 26, 2019).

*Primary Examiner* — F Griffin Hall
(74) *Attorney, Agent, or Firm* — Lucas & Mercanti, LLP

(57) ABSTRACT

A safety helmet is disclosed having a shell and a comfort liner coupled to the inner surface of the shell. The comfort liner is constrained to the front part and to the rear part of the shell, and the helmet has a webbing arranged between the shell and the comfort liner along the upper median portion of the comfort liner. The webbing has a front end constrained to the front part of the comfort liner and a rear end to move the webbing with respect to the shell and cause consequently the change of the overall dimensions of the comfort liner inside the helmet. The webbing is constrained, with respect to the shell, in an operative position corresponding to the overall dimensions of the comfort liner inside the helmet.

8 Claims, 2 Drawing Sheets

(56) References Cited

U.S. PATENT DOCUMENTS

2014/0366252 A1 12/2014 Mazzarolo et al.
2017/0273390 A1* 9/2017 Maloney ..... A42B 3/145

* cited by examiner

SAFETY HELMET WITH ADJUSTABLE COMFORT LINER

CROSS-REFERENCE TO RELATED APPLICATION

This application claims the benefit of priority from Italian Patent Application No. 102018000007484, filed Jul. 25, 2018, the contents of which are incorporated herein by reference.

FIELD OF THE INVENTION

The present invention concerns the field of safety helmets. In particular, the present invention is especially used in the field of safety helmets provided with a comfort liner (or also named cap), typically removably constrained at the inner surface of the shell of the helmet.

BACKGROUND OF THE INVENTION

Safety helmets can be used in different fields, such as for example in sports (motorcycling, cycling, football, etc.), in civil professions (fireman's helmets, construction helmets, etc.), as well as in law enforcement (riot control helmets, and the like).

The safety helmets are generally provided with a shell made of a shock-resistant material so that to protect the user's head from unexpected impacts.

For example, in the case of motorcycling helmets, the shell generally comprises an outer casing, typically made of ABS, polycarbonate, etc. or of a composite material, such as carbon and/or aramid and/or glass fibers, and a layer of shock-absorbing material, typically a foam material such as for example polystyrene. Together, the outer casing and shock-absorbing layer form that which will, here and hereinafter, be generically denoted as "shell," which substantially constitutes that portion of helmet adapted to accommodate the user's head.

Safety helmets provided with a comfort liner coupled to the inner surface of the shell are known. Such liner (also named "cap") is intended to make the shell of the helmet comfortable on the wearer's head.

In particular, the comfort liner is shaped to be interposed between the shell and the user's head and is generally arranged to adhere at least on top of the user's head, where the weight of the shell exerts more pressure on the user's head.

For the user, the comfort liner is thus a decisive element in assessing the comfort of a safety helmet. Comfort liners, having different thicknesses and/or shapes that can be replaced in a same helmet so that to obtain different overall dimensions inside the shell and to provide the desired comfort to the user, are thus known.

However, replacing the comfort liner can often be a long and complex operation for the user who often prefers to settle for a non-satisfying degree of comfort instead of carrying out long and complex helmet disassembling and assembling operations.

There is thus a need to adjust the overall dimensions of the comfort liner inside safety helmets in a simpler and faster manner. An object of the present invention is to provide a safety helmet provided with a comfort liner able to be adjusted by the user in a simple and fast manner.

A further object of the present invention is to provide a safety helmet provided with an economic and simple to make adjustable comfort liner.

BRIEF SUMMARY OF THE INVENTION

The present invention thus intends to achieve the objects described above by means of a safety helmet according to claim 1.

Further characteristics of the invention can be deduced from the dependent claims.

In particular, the safety helmet according to the present invention comprises a shell and a comfort liner coupled to the inner surface of the shell. In particular, the comfort liner is constrained to the front part and to the rear part of the shell.

According to an aspect of the present invention, the safety helmet comprises a webbing arranged between the shell and the comfort liner along the upper median portion of the comfort liner.

Such webbing further comprises a front end constrained to the front part of the comfort liner and a rear end adapted to move the webbing, with respect to the shell, to cause consequently the change of the overall dimensions of the comfort liner inside the helmet.

The webbing is further designed to be constrained, with respect to the shell, in at least one operative position corresponding to desired overall dimensions of the comfort liner inside the helmet.

Thanks to the present invention, it is thus possible to move the comfort liner, with respect to the shell, in order to adjust the overall dimensions inside the helmet without having to fully remove the comfort liner from the shell (for example to replace it with one of different shape).

In particular, the webbing allows the user to move the comfort liner in a simple and fast manner and to maintain the comfort by constraining the webbing to the shell of the helmet.

Advantageously, the rear end of the webbing is provided with an activating tongue accessible from the rear part of the shell.

Preferably, the activating tongue is designed to be constrained, directly or indirectly, to the rear part of the shell in a plurality of predetermined positions corresponding to different overall dimensions of the comfort liner inside the helmet.

Advantageously, a preferred embodiment provides that the activating tongue is provided with a plurality of slots designed to be engaged in a relief which is constrained, directly or indirectly, to the rear part of the shell. For example, if the aforesaid relief is constrained indirectly to the rear part of the shell, the relief is preferably constrained to the rear part of the comfort liner.

Preferably, the webbing is restrained on the comfort liner by one or more loops which are arranged transversely with respect to the webbing on top of the comfort liner along the upper median portion of the comfort liner (i.e. along the path engaged by the webbing between the front part and the rear part of the comfort liner).

Advantageously, the comfort liner comprises a central portion having an outer surface with shape substantially coincident with the inner surface of the shell.

Preferably, the comfort liner comprises an inner layer having substantially concave shape and being adapted to rest directly on the user's head, and a deformable outer layer adapted to cover the outer surface of the inner layer.

Preferably, the helmet comprises at least one tie string provided with at least one end constrained to the webbing and at least one second end constrained to a side portion of the comfort liner.

According to an aspect of the present invention, the shell of the helmet comprises an outer casing and at least one layer of shock-absorbing material coupled to the inner surface of the outer casing.

Preferably, the helmet of the present invention is a motorcycling helmet.

BRIEF DESCRIPTION OF THE FIGURES

Further characteristics and advantages of the invention will become more evident in the light of the following detailed description with the aid of the accompanying tables of drawings, in which.

DETAILED DESCRIPTION OF THE INVENTION

The invention will now be described with initial reference to FIGS. 1A and 1B in which a longitudinal sectional view of a safety helmet 1 according to a particular embodiment of the present invention is schematically shown.

Figure 1B:
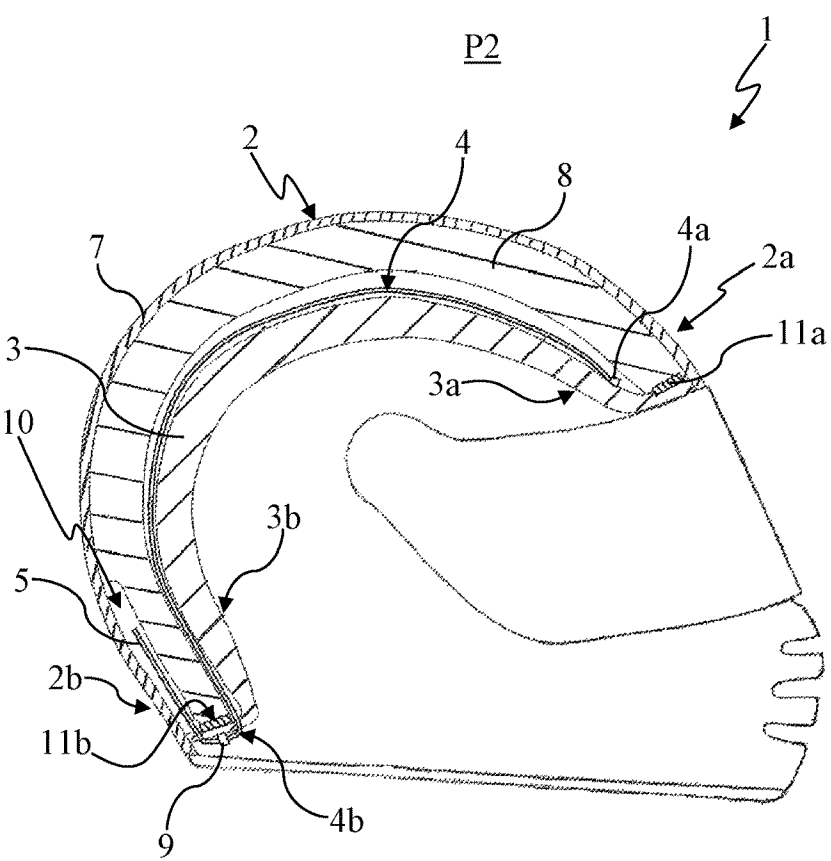
FIGS. 1A and 1B schematically show a longitudinal sectional view of a safety helmet according to a particular embodiment of the present invention.
Figure 1A:
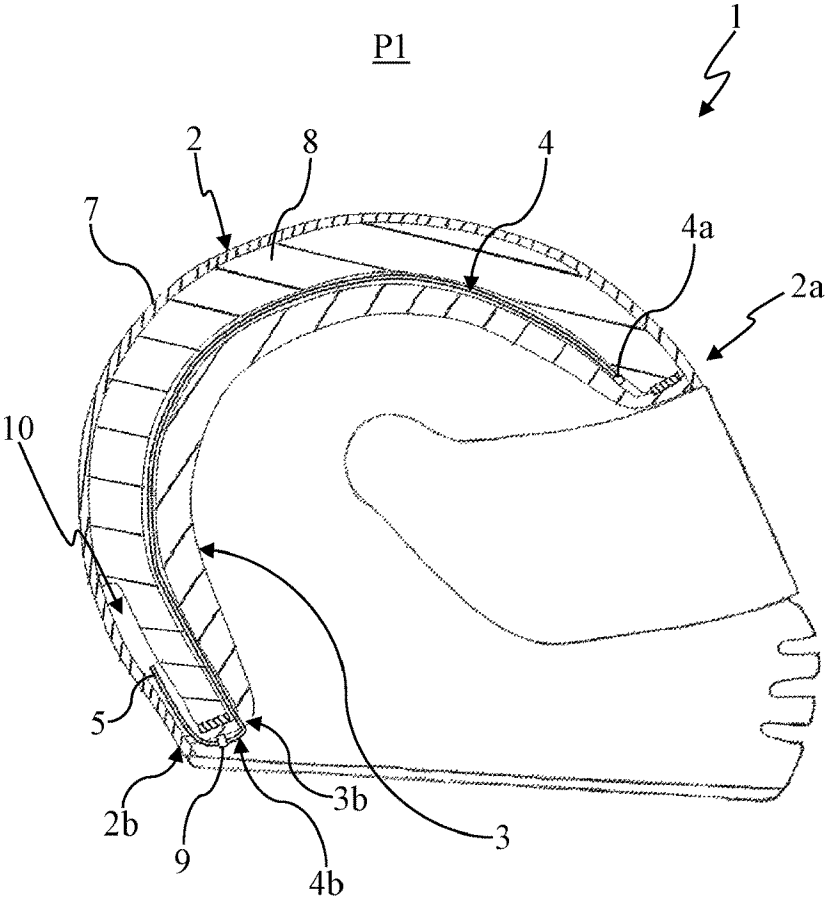

In particular, the safety helmet 1 shown in FIGS. 1A and 1B is preferably a motorcycling helmet. Such helmet 1 comprises a shell 2 and a comfort liner 3 coupled to the inner surface of the shell 2.

In the embodiment shown in FIGS. 1A and 1B, the shell 2 preferably comprises an outer casing 7 (for example made of ABS, polycarbonate, and/or made of a composite material, such as carbon and/or aramid and/or glass fibers) and a shock-absorbing layer 8 (made of a foam material such as for example polystyrene) coupled to the inner surface of the outer casing 7.

The comfort liner 3 is constrained to the front part 2*a* and to the rear part 2*b* of the shell 2. For example, the comfort liner 3 can be removably constrained to the shell 2 by means of snap members (such as for example buckles, buttons, or the like), or by means of Velcro or, in general, by means of hooking members to removably constrain the comfort liner 3 to the shell 2.

The helmet further comprises a webbing 4 arranged between the shell 2 and the comfort liner 3. The webbing 4 is arranged along the upper median portion of the comfort liner 3.

In other words, the webbing 4 is arranged above the comfort liner 3 along the longitudinal direction linking the front part 2*a* and the rear part 2*b* of the shell 2.

The webbing 4 further comprises a front end 4*a* constrained to the front part 3*a* of the comfort liner 3 and a rear end 4*b* to move the webbing 4, with respect to the shell 2, and cause consequently the change of the overall dimensions of the comfort liner 3 inside the helmet 1.

The rear end 4*b* of the webbing 4 is accessible to the user from the rear part of the helmet. In particular, by acting on the rear end 4*b* of the webbing 4, the user can move the webbing 4 along the longitudinal direction of the comfort liner 3 by adjusting the length of the webbing accommodated between the shell 2 and the comfort liner 3.

The comfort liner 3 comprises a central portion 3*c* having an outer surface with shape substantially coincident with the inner surface of the shell 2.

The central portion 3*c* of the comfort liner 3 (i.e. the portion of the comfort liner 3 arranged between the front part 2*a* of the shell 2 and the rear part 2*b* of the shell 2) is substantially devoid of constraints with the shell 2 and is movable with respect to the shell 2 by means of the webbing 4.

For example, starting from the configuration shown in FIG. 1A, in which the webbing 4 is constrained in a first operative position P1, the user can move the webbing 4 longitudinally towards the rear part 2*b* of the shell 2, by pulling the rear end 4*b* outwardly and constrain the webbing 4 in a second operative position P2 (shown in FIG. 1B).

With reference to FIG. 1B, the movement of the webbing 4 causes the comfort liner 3 to be spaced from the inner surface of the shell 2 (i.e. a movement of the comfort liner 3 away from the inner surface of the shell 2).

The movement of the comfort liner 3 away from the inner surface of the shell 2 acts on the motorcyclist's head as if the overall dimensions of the comfort liner 3 were increased inside the helmet 1, which consequently assumes a different relative position (arrangement).

The webbing 4 is thus designed to be constrained, with respect to the shell 2, in at least one operative position (P1, P2) corresponding to desired overall dimensions of the comfort liner 3 inside the helmet 1.

In other words, thanks to the present invention, the user can advantageously change at will the overall dimensions inside the helmet without having to fully remove the liner from the shell. Possibly, the user can only release the rear part 3*b* of the liner from the shell 2 to facilitate the movement of the webbing. Once the desired overall dimensions have been obtained, the webbing 4 can be constrained, directly or indirectly, to the shell 2 to maintain the desired operative position.

Preferably, the rear end 4*b* of the webbing 4 is provided with an activating tongue 5 accessible from the rear part 2*b* of the shell 2. The tongue 5 can advantageously be housed in a seat 10 obtained in the shell 2, for example obtained in the shock-absorbing layer 8, preferably arranged between the shock-absorbing layer 8 and the outer casing 7.

Figure 2:
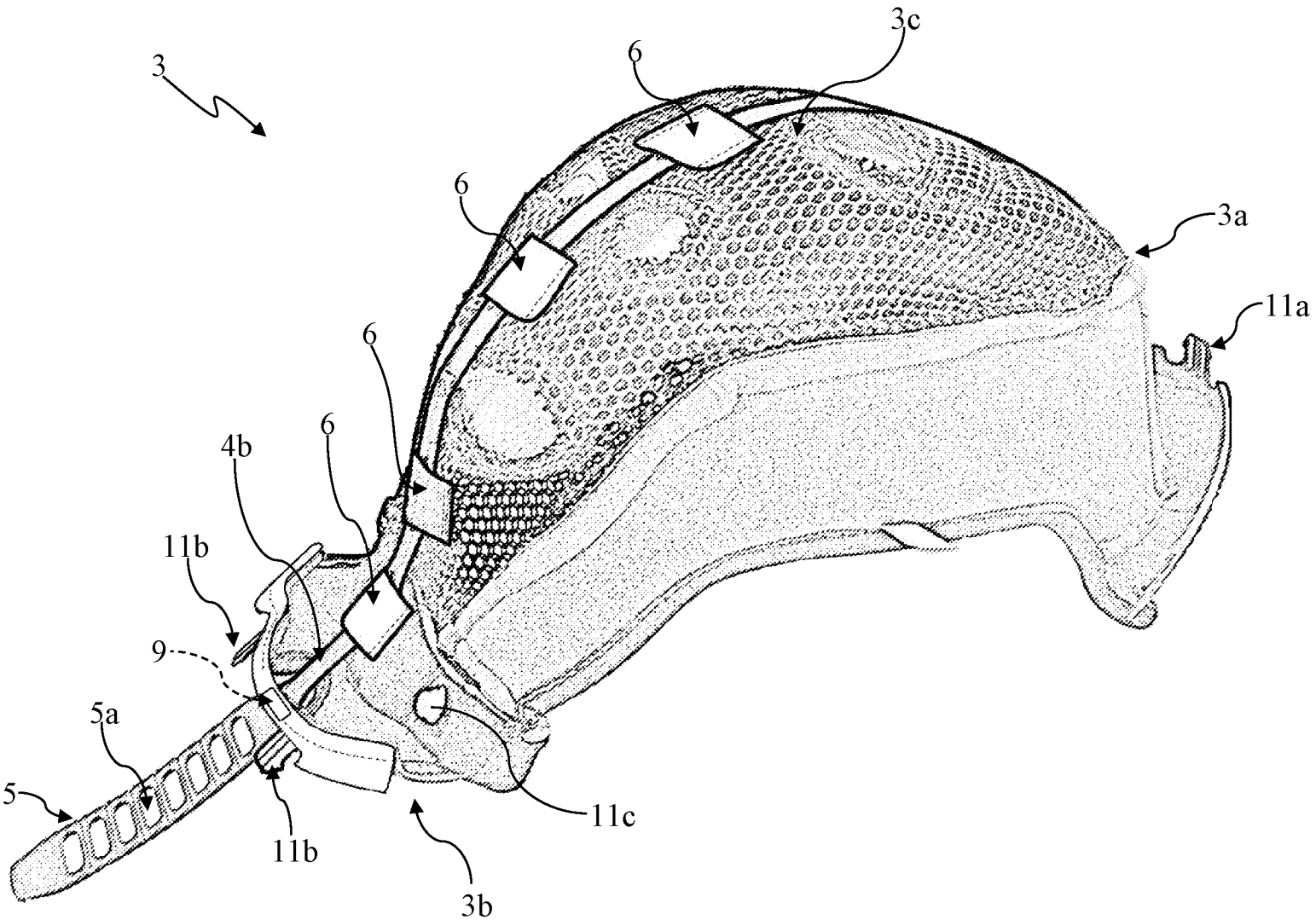
FIG. 2 schematically shows a perspective view of a comfort liner for a safety helmet according to a particular embodiment of the present invention.

A comfort liner 3 according to a particular embodiment of the safety helmet 1 of the present invention is shown in FIG. 2. In this embodiment, the central portion 3*c* of the comfort liner 3 is made with a layered structure and preferably comprises an inner layer (for example a foam rubber layer coupled to fabric or the like) having a substantially concave shape that acts inside the helmet by resting directly on the user's head, and a deformable outer layer of fabric, preferably of the breathable type (for example an elastic netting), adapted to cover the outer surface of the inner layer. The outer layer, directly facing the inner surface of the shell 2, preferably has slot-shaped openings arranged transversely with respect to the longitudinal direction along which the webbing 4 is positioned.

The inner layer of the comfort liner 3 is fixed to the outer one at the front part 3*a* and at the rear part 3*b* of the liner 3 by means of seams or other fastening/coupling/welding systems per se known in the art.

With reference to FIG. 2, the front end 4*a* of the webbing 4 is constrained to the rear part 3*a* of the outer layer of the comfort liner 3, for example by means of seams. Preferably, the webbing 4 is restrained on the outer layer of the comfort liner 3 by one or more loops 6 arranged transversely with respect to the webbing 4 on top of the comfort liner 3.

When the webbing 4 is pulled, it begins to slide through the loops 6 and drags with it the deformable outer layer of the central portion 3*c* of the comfort liner which, thanks to the slot-shaped openings present in the fabric, begins to "shorten," as if it were a "bellows," and to reduce its length. The inner layer of the central portion 3*c*, being constrained to the outer layer at the front part and at the rear part, is consequently moved with respect to the inner surface of the shell 2, changing its concavity.

The comfort liner 3 can be constrained to the shell 2 of the safety helmet 1 by means of snap-buckles 11*a*, 11*b* respectively arranged at the front part 3*a* and at the rear part 3*b* of the comfort liner 3. With reference to FIG. 2, the comfort liner 3 preferably comprises one or more snap members 11*c* arranged for example in the rear part 3*b* of the comfort liner. Such snap members 11*c* are designed to couple to corresponding coupling members (not shown) arranged on the inner surface of the shell 2 of the safety helmet 1.

The comfort liner 3 can thus easily be constrained to the shell 2, by at first inserting the central part 3*c* of the liner 3 inside the shell 2 so that the front 3*a* and rear 3*b* parts of the liner 3 correspond respectively to the front 2*a* and rear 2*b* parts of the shell 2. The front part 3*a* of the liner is thus constrained to the shell 2 by hooking the snap-buckle 11*a* to a corresponding seat of the shell 2 (for example obtained in the shock-absorbing layer 8). Similarly, also the rear part is constrained to the shell by hooking the snap-buckle 11*b*, and possibly the snap member 11*c*, if present, to corresponding seats obtained in the shell 2.

With reference to FIG. 2, the activating tongue 5 comprises a plurality of slots 5*a* designed to be engaged in a relief 9 (shown by dotted lines) which is constrained to the rear part 3*b* of the comfort liner 3. Further embodiments can however provide that the relief 9 is directly arranged on the shell 2, for example at an opening obtained on the rear part of the comfort liner. In general, the relief 9 can be constrained, directly or indirectly, to the rear part 2*b* of said shell 2.

In the embodiment shown in FIG. 2, the activating tongue 5 is designed to move the webbing 4 so that to obtain given desired overall dimensions of the comfort liner 3 inside the helmet and to constrain the webbing 4 in the position corresponding to the overall dimensions obtained. In particular, the activating tongue 5 is constrained to the shell 2, by engaging the relief 9 in one of the slots 5*a*.

Further embodiments can however provide different means for constraining the activating tongue 5 to the shell 2 of the helmet. For example, some embodiments can provide for the presence of a clamp or similar restraining means constrained to the shell 2 of the helmet 1. In these embodiments, the clamp is provided with a passage between two mobile parts (jaws) of the clamp. When the clamp is open, the tongue can slide through the passage, by closing the clamp the tongue is pressed in-between the two jaws and constrained to the shell 2 of the helmet 1.

In general, the activating tongue 5 is designed to be constrained, directly or indirectly, to the rear part 2*b* of the shell 2 in a plurality of predetermined positions corresponding to different overall dimensions of the comfort liner 3 inside the helmet 1.

Obviously, changes or improvements can be made to the invention as described without thereby departing from the scope of the invention as claimed hereunder.

For example, some embodiments not shown in the figures can provide that the webbing is provided with one or more tie strings, to move the comfort liner 3 by acting on several points simultaneously.

A preferred embodiment can for example provide that each tie string is provided with a first end constrained to the webbing 4 and a second end constrained to a side portion of the comfort liner 3.

The invention claimed is:

1. A helmet comprising:

a shell, and a comfort liner, the comfort liner comprising a central portion having an outer surface with a shape substantially coincident with an inner central surface of the shell, the central portion being substantially devoid of constraints with the shell, and being arranged between a front part of the shell and a rear part of the shell, the comfort liner further comprising an inner layer having a substantially concave shape being adapted to act inside the helmet by resting directly on a user's head, the comfort liner being coupled to an inner surface of said shell, said comfort liner being constrained to portions the front part and the rear part of said shell, wherein the helmet further comprises a webbing arranged between the shell and the comfort liner along an upper median portion of said comfort liner, said webbing comprising a first end constrained to a front part of the comfort liner and a second end configured to move the webbing with respect to a longitudinal direction of the shell and to cause consequently a change of the overall dimensions of said comfort liner inside the helmet by correspondingly moving the central portion of the comfort liner with respect to the shell, said webbing being configured to be constrained, with respect to the longitudinal direction of the shell, in an operative position corresponding to desired overall dimensions of said comfort liner inside the helmet.

2. The helmet according to claim 1, wherein said second end of the webbing is provided with an accessible activating tongue.

3. The helmet according to claim 2, wherein said activating tongue is designed to be constrained, directly or indirectly, to the shell in a plurality of predetermined positions corresponding to different overall dimensions of said comfort liner inside the helmet.

4. The helmet according to claim 3, wherein said activating tongue comprises a plurality of slots configured to be engaged in a relief which is constrained, directly or indirectly, to the shell.

5. The helmet according to claim 4, wherein said relief is constrained to the comfort liner.

6. The helmet according to claim 1, wherein said webbing is constrained on the comfort liner by one or more loops which are arranged transversely with respect to said webbing along the upper median portion of said comfort liner.

7. The helmet according to claim 1, wherein said comfort liner comprises an inner layer having a substantially concave shape and being adapted to rest on the user's head directly, and a deformable outer layer adapted to cover an outer surface of said inner layer.

8. The helmet according to claim 1, wherein said shell comprises an outer casing and a layer of shock-absorbing material coupled to the inner surface of said outer casing.

* * * * *